US005990780A

United States Patent [19]

Caddock, Jr.

[11] Patent Number: 5,990,780

[45] Date of Patent: Nov. 23, 1999

[54] LOW-RESISTANCE, HIGH-POWER RESISTOR HAVING A TIGHT RESISTANCE TOLERANCE DESPITE VARIATIONS IN THE CIRCUIT CONNECTIONS TO THE CONTACTS

[75] Inventor: Richard E. Caddock, Jr., Winchester, Oreg.

[73] Assignee: Caddock Electronics, Inc., Riverside, Calif.

[21] Appl. No.: 09/019,891

[22] Filed: Feb. 6, 1998

[51] Int. Cl.[6] ..... H01C 1/012

[52] U.S. Cl. ..... 338/309; 338/327; 338/328

[58] Field of Search ..... 338/309, 312, 338/313, 314, 315, 325, 328, 327

[56] References Cited

PUBLICATIONS

Caddock Catalog sheet (printed on one side only), copyright 1996, entitled "Type CC Low Resistance Precision Chip Resistors".

Caddock Advertising sheet (printed on one side only), copyright 1997, entitled "Current Sense Resistors".

Page 9 taken the Caddock general catalog 26th edition, entitled "Type SR Precision Current Sense Resistors".

Catalog of Isotek Corporation (about 28 pages), and portions of such catalog stapled together with added sheets.

Dale Electronics, Inc. catalog sheet (two pages) titled "Model WSL Power Metal Strip Resistor Low Value, Surface Mount".

Publication by International Resistive Company—two page catalog sheet having and "ICR" logo at the top of each sheet.

Publication by International Resistive Companyp—catalog having 11 pages. The title on each page (next to the IRC logo) is "ICR Low Range Chip Resistors vs Metal Strip Resistors—Application Nnote IRC/AFD004".

*Primary Examiner*—Michael L. Gellner
*Assistant Examiner*—Richard Lee
*Attorney, Agent, or Firm*—Oppenheimer Wolff & Donnelly LLP

[57] ABSTRACT

A tight-tolerance, low-resistance, high-power chip resistor for mounting on a circuit board in parallel and adjacent relationship to such board. There are discrete terminal plates mounted on one surface of a substrate, in spaced-apart relationship to each other but still quite close to each other. Electrical connections are made by the customer to the terminal plates, at different regions thereof, without adversely affecting the tight-tolerance relationship. The terminal plates additionally provide heat spreading from the resistance film, enhancing the power handling capability of this low-resistance, high-power chip resistor.

35 Claims, 2 Drawing Sheets

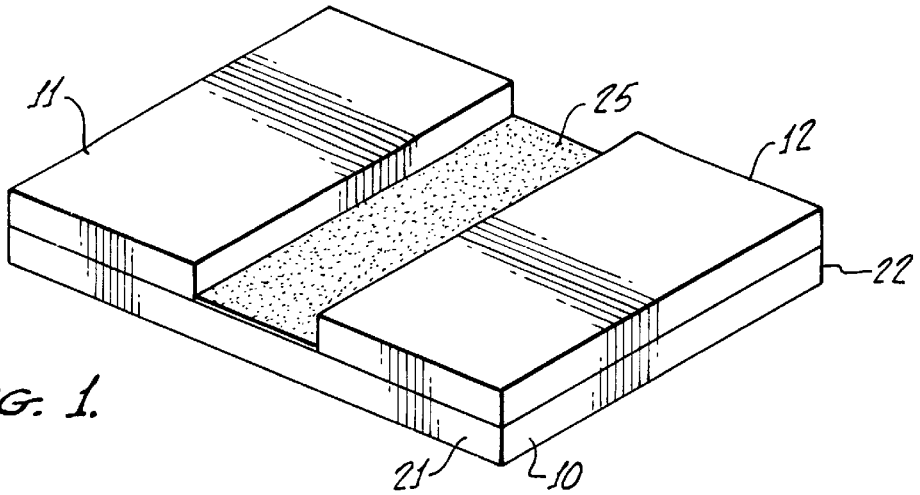
FIG. 1.
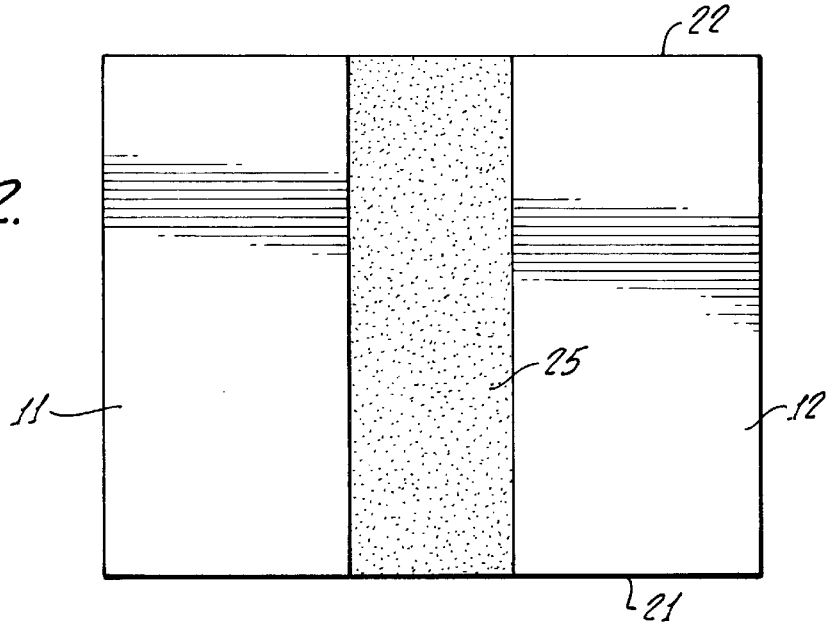
FIG. 2.
FIG. 3.
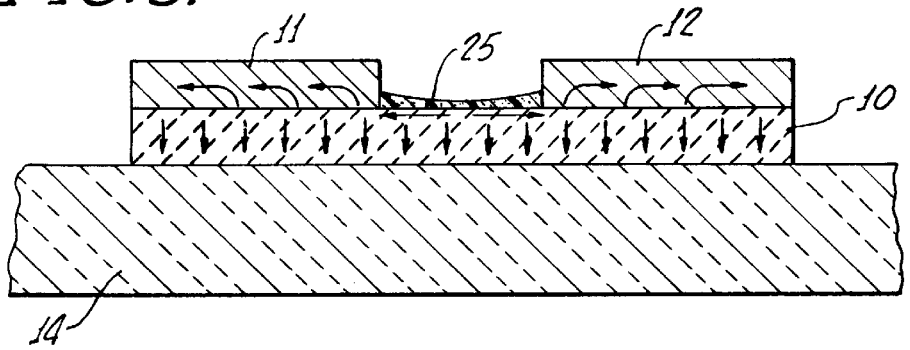

LOW-RESISTANCE, HIGH-POWER RESISTOR HAVING A TIGHT RESISTANCE TOLERANCE DESPITE VARIATIONS IN THE CIRCUIT CONNECTIONS TO THE CONTACTS

SUMMARY OF THE INVENTION

The prevent low-resistance chip resistor has a small film area relative to resistor size, and has a very high power rating relative to the film area. It has large (in comparison to the size of the resistor) terminal plates with low contact resistance (for the user) and a tight resistance tolerance (for a low-resistance two-terminal chip resistor). This low-resistance resistor maintains its relatively tight tolerance despite normal connection variations (variations in the points of contact to the resistor) made by manufacturers in connecting the present resistor in circuit.

The resistance deposit preferably has a narrow width versus its height (length), which aids in achieving heat flow from the resistance film into terminal plates and in achieving a low resistance value, namely a fraction of a square of the resistance material.

The present resistor incorporates a ceramic substrate and employs thick-film screen-printing technology. These and other factors make the present resistor relatively economical to manufacture.

The terminal plates of the present resistor are on the same side of the ceramic substrate as is the resistance film.

The present resistor has a resistance value of about 1 ohm and below.

The present resistor, in one of its embodiments, has a power rating of 20 watts when the interface between the resistor and the heat-sink surface is maintained at 25° C.

The present resistor achieves improved thermal spreading at the terminals, and transfers heat vertically into a heat-dissipating circuit substrate.

The present resistor achieves high-precision resistance tolerances relative to the low resistance values. It provides very low-resistance, high thermal-conductivity terminal plates. The terminal plates cause thermal spreading that helps achieve extra power rating plus very low-resistance contact areas (for the user). This results in very reliable forgiving contacts, and thereby relatively tight tolerances that are maintained relative to connection variations in the user's application. Typical resistance tolerances most useful in the present invention range from about 1% (plus or minus) to as tight as 0.1% (plus or minus). These are for the above-indicated resistance values of about 1 ohm and lower. It is to be understood that the present resistor may also be used for loose resistance tolerances, while still benefiting from the thermal-spreading and heat-transfer aspects of the resistor.

The present resistor preferably incorporates an environmental coating in combination with terminal plates, the latter serving also as marginal walls for the environmental coating. This aids in achieving a very clean, small, precision, durable resistor having the above-specified and other benefits.

It is an advantage of the present resistor combination that the user may vary the connection positions from the user's circuit to the terminals of the present resistor, without substantially changing the resistor tolerance. This allows the forgiving use of the resistor in the user's manufacturing. This device is particularly useful for resistive current sensing.

BRIEF DESCRIPTION OF THE DRAWINGS

FIG. 1 is an isometric view (highly enlarged) of a resistor incorporating the present invention;

FIG. 2 is a top plan view thereof;

FIG. 3 is a schematic cross-sectional view thereof, showing the resistor in combination with a heat-sinking circuit substrate, and further showing heat flow patterns in the resistor;

Figure 4:
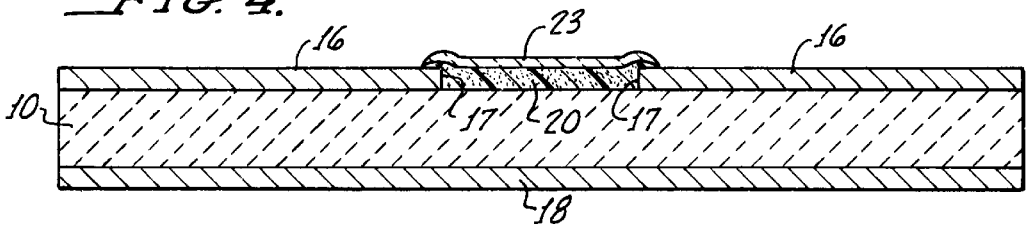
FIG. 4 is a further enlarged sectional view showing elements of the present resistor prior to mounting of the terminal plates thereon and prior to application of the environmental coating.
Figure 5:
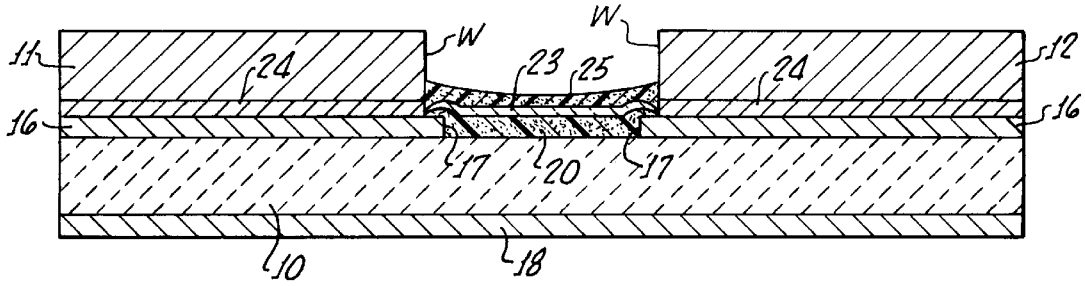
FIG. 5 corresponds to FIG. 4 but also shows the terminal plates and the environmental coating therebetween.
Figure 6:
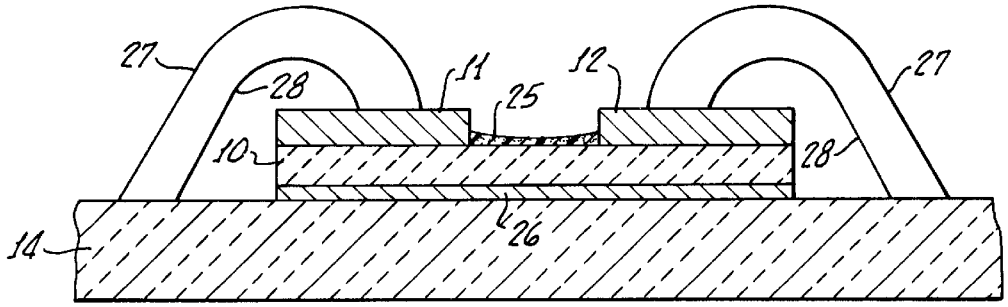
FIG. 6 is a schematic view showing a first embodiment of the combination of the present resistor with a heat-sinking circuit substrate.
Figure 7:
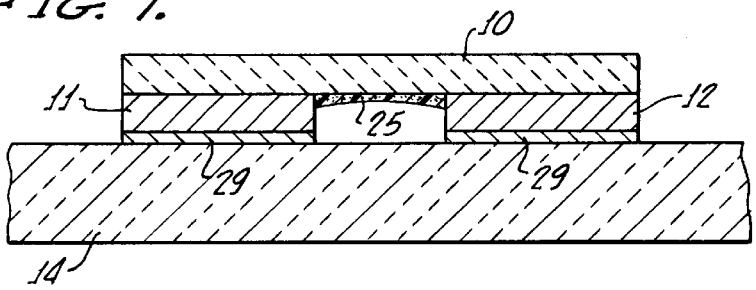
FIG. 7 is a schematic view showing a second combination of the present resistor with a heat-sinking circuit substrate.

The resistance film and glass coating thereover are not shown in schematic FIGS. 3, 6 and 7, but they are nevertheless present as shown in sectional views FIGS. 4 and 5.

DEFINITION

The words "terminal plate", as used in this specification and claims (including any continuation or continuation-in-part or divisional patent application specification and claims) mean a discrete plate preformed of a highly electrically conductive and highly thermally conductive substance such as (for example) copper. There is no implication that the plate is per se "large", it being instead per se small—typically having a dimension such as about one-half inch or less on a side. Each plate is, however, large in comparison to the size of the present resistor combination.

DETAILED DESCRIPTION OF THE PREFERRED EMBODIMENT

The resistor comprises a substrate 10 (resistor substrate) on which terminal plates 11,12 are mounted in spaced apart relationship relative to each other. Terminal plates 11,12 are large in comparison to the size of substrate 10. There is a fractional square of resistance material 20 (shown only in FIGS. 4 and 5) which preferably uses less than 50% of the top surface area of the substrate 10.

Each terminal plate 11,12 is preferably formed of copper. Each has a very low electrical and thermal resistance. There are provided low resistance connections to the resistance film 20 on the resistor substrate 10. A low resistance resistor is achieved, having ± 1% to as tight as ± 0.1% tolerance on resistance values of under about 1.0 ohm. This is achieved in a resistor which is easy to apply in circuit, and which maintains the stated tolerances in circuit. As above indicated, this resistor is not limited to tight tolerances since a loose tolerance resistor can also benefit from the heat spreading and thermal transfer aspects described herein.

The present resistor is typically combined by the user with a heat-sinking circuit substrate 14. Circuit substrate 14 is a heat-sinking support that typically contains electric circuit elements (not shown). Circuit substrate 14 preferably comprises a Berkquist thermal clad IMS (insulated metal substrate) board which has (for example) an aluminum substrate. Alternatively, the circuit substrate 14 is a relatively large glass-epoxy circuit board preferably having relatively large copper pads thereon for heat sinking (the board circuitry being unshown).

The substrate 10 (resistor substrate) is preferably formed of ceramic such as aluminum oxide, beryllia, or aluminum nitride.

There is efficient spreading of heat from the resistor to the circuit substrate due to the fact that there is a short, lateral, thermal path in the resistor substrate 10, from the heat-generating resistance film to the terminal plates 11,12. Referring particularly to FIG. 3, and referring to the arrows thereon, heat spreads through the short, lateral (to the left and to the right in FIG. 3) thermal path in the resistor substrate 10, from the heat generating resistance film to the terminal plates 11,12. The high thermal conductivity of the terminal plates 11,12 causes efficient heat spreading (pulling heat away from the resistance material and spreading the heat across the widths of the terminal plates 11,12), which allows the areas of the terminal plates 11,12 to dissipate heat vertically (FIG. 3) into the heat sinking connections to the circuit substrate 14.

Stated otherwise, heat generated in the resistance material between terminal plates 11,12 flows vertically downwardly. Some of this heat goes directly downwardly into the circuit substrate 14; other of this heat flows horizontally to the left and right, and thence both upwardly into the terminal plates 11,12 and downwardly into the circuit substrate 14.

Referring next to FIG. 4, there is shown the power resistor substrate 10 after screen printing and firing steps. (It is to be noted that FIG. 4, like other figures of the present patent application, is not to scale.)

Except as stated below, the upper surface of resistor substrate 10 is coated with metalization. The purpose of such metalization is to efficiently electrically connect to the resistance film, as well as to aid in efficiently electrically and thermally connecting the terminal plates 11,12 to the resistor substrate 10.

Metalization layers 16 are screen printed onto the upper surface of substrate 10 on opposite sides of the central region of such upper surface. The metalization layers 16 cover substantially the entire upper surface of substrate 10 except at such central region. The indicated central region is between two parallel edges 17 of the screen printed metalizations. Edges 17 extend for substantially the full width of substrate 10, in directions perpendicular to the paper on which FIG. 4 is drawn. The bottom surface of substrate 10 is also screen-printed to apply metalization thereto, although such latter-indicated metalization may be omitted in the embodiment described subsequently relative to FIG. 7. Such last-indicated metalization has the reference numeral 18.

Resistance material 20 is, as shown in FIG. 4, provided on the upper surface of substrate 10 between edges 17 of the metalization films 16. Stated more specifically, the resistance material is the resistance film 20 that is screen printed on the upper surface of substrate 10 between the edges 17 and in electrical contact with the lengths of such edges 17. It is to be understood that the showing of FIG. 4 (and FIG. 5) is representative of a section taken at substantially any point from one side edge of the resistor combination to the other. The resistance film is applied by screen printing and is then fired. The resistance film is composed of electrically conductive metal particles with a glass binder.

As shown in FIGS. 4 and 5, the regions of the resistance film 20 adjacent edges 17 slightly overlap such edges, in the preferred embodiment. Also in the preferred embodiment, there is caused to be a small space between side edges 21,22 (FIGS. 1 and 2) of substrate 21 and the adjacent regions of resistance film 20.

As shown only in FIGS. 4 and 5, there is applied over the upper surface of resistance film 20, and then fired, a layer of glass (overglaze). This is done by screen-printing in the preferred embodiment, and preferably the overglaze extends to the marginal regions of the resistance film. This glass layer is given the reference numeral 23.

Each terminal plate 11,12 is, as shown schematically in FIG. 5, electrically connected and bonded to the upper metalization layers or films 16 on the resistor substrate 10. The terminal plate has a solderable finish on the surface that is adjacent to layer 16. Preferably, this is performed by soldering with 95Sn/5Ag solder, indicated at 24 in FIG. 5 only. The solder 24 and metalizations 16 cooperate both in effecting efficient electrical conductivity between terminal plates 11,12 and resistance film 20, and good thermal conductivity between such terminal plates 11,12 and resistor substrate 10.

The same resistor shown in FIG. 5 is shown in FIG. 6 as being electrically and thermally connected to a circuit substrate 14. Solder 26 is employed to electrically and thermally connect the bottom metalization (number 18, not shown in FIG. 6) to the upper heat-sinking surface of the circuit substrate 14.

In the connection shown in FIG. 6, four leads (preferably aluminum wires) are connected (wire bonded) between circuit substrate 14 (at suitable circuit terminal points thereon) and the upper surfaces of the terminal plates 11,12. The upper surface of each terminal plate 11,12 has a wire bondable finish (such as a nickel plate for bonding aluminum wire). There are shown two leads for each terminal plate. In the illustrated form, two of the leads (one for each terminal plate) are sense leads, these being numbered 27. The remaining two leads, numbered 28, are current leads.

FIG. 6, accordingly, shows the combination of the present resistor with a heat-sinking circuit substrate, in parallel relation thereto and closely coupled for heat-sinking purposes. There are electrical connections from the circuit substrate to the terminal plates 11,12.

The solder 26 is, for example, 62Sn/36Pb/2Ag solder.

It is to be understood that there may be multiple current wire bonds to each terminal plate 11,12, depending upon the magnitude of current present.

Referring next to FIG. 7, the same resistor described in detail herein is shown in inverted condition, with the resistor substrate uppermost and the terminal plates 11,12 lowermost. The lowermost surface of terminal plates 11,12, in this application, has a solderable finish. There is electrical and thermal bonding of the terminal plates 11,12 to the circuit substrate 14 preferably by solder 62Sn/36Pb/2Ag. This solder is indicated at 29. Metalization layer 18 may or may not be present in this embodiment. The heat flow patterns in the combination shown in FIG. 7 are not the same as those shown and described relative to FIG. 3. For example, in the combination of FIG. 7 no substantial heat flows directly vertically downwardly from the resistance film 20 to the heat sinking substrate 14.

The glass 23 (FIGS. 4 and 5) typically extends closer to the side edges 21,22 of resistor substrate 10 than does the resistance film 20, so that the glass substantially covers the film. There is next described an environmental coating 25 that is applied over the glass in order to improve greatly the ability of the present resistor to withstand ambient and environmental conditions. This environmental coating may be made of various synthetic resins known in the art, for example a suitable polymer.

The environmental coating 25 is best shown in FIG. 5. As there shown, the opposed walls w of the terminal plates 11,12 extend upwardly from the solder 24 that connects to metalization layers 16. In accordance with one aspect of the present invention, liquid environmental coating material (such as a suitable polymer) is deposited (as by a syringe) between walls w over the glass layer 23 and outwardly above the marginal regions of the glass layer 23, between such marginal regions and the walls w. A curing step is then performed to cure the polymer 25. The polymer layer 25 covers substantially all portions of the glass layer 23, which in turn covers the resistance material 20 at substantially all regions thereof.

The environmental coating 25 is applied after the resistor is trimmed to the desired resistance value. Trimming is preferably effected after glass layer 23 is applied and fired, and after terminal plates 11,12 are applied. Preferably, the trimming is done by laser, by scanning one or more laser cuts, the cuts being preferably made in a direction parallel to current flow, namely perpendicular to walls w (FIG. 5).

The foregoing detailed description is to be clearly understood as given by way of illustration and example only, the spirit and scope of this invention being limited solely by the appended claims.

What is claimed is:

1. A low-resistance, high-power chip resistor having tight resistance tolerances despite variations in circuit connections to said resistor, said resistor comprising:

(a) a ceramic resistor substrate, (b) metalizations provided on the upper surface of said substrate, there being two metalizations spaced apart from each other to provide a space therebetween, (c) a resistance film provided on said upper surface of said substrate in said space between said metalizations, and (d) first and second discrete spaced-apart low-resistivity, high-thermal-conductivity terminal plates, said terminal plates being respectively electrically connected to the upper surfaces of said metalizations and to said resistance film, each of said terminal plates extending across said substrate from one side region thereof to the opposite side region thereof.

2. The invention as claimed in claim 1, in which said resistor has an electrical resistance value in the range of one ohm and below.

3. The invention as claimed in claim 1, in which said resistor is mounted on and parallel to a heat-sinking circuit substrate in heat-sinking relationship thereto.

4. The invention as claimed in claim 3, in which said heat-sinking relationship to said circuit substrate comprises means to bond the lower surface of said ceramic resistor substrate to the upper surface of said heat-sinking circuit substrate.

5. The invention as claimed in claim 3, in which said heat-sinking relationship to said circuit substrate comprises means to bond the upper surfaces of said terminal plates to the upper surface of said heat-sinking circuit substrate such that said resistance film faces the upper surface of said heat-sinking circuit substrate.

6. The invention as claimed in claim 4, in which current leads are connected between said heat-sinking circuit substrate and said respective terminal plates, and in which sense leads are connected between said heat-sinking circuit substrate and said respective terminal plates.

7. The invention as claimed in claim 6, in which the resistance tolerances of said resistor are in the range about 0.1% to about 1% despite random variations in the locations at which said leads are connected to said terminal plates.

8. The invention as claimed in claim 1, in which a glass coating is provided over said resistance film.

9. The invention as claimed in claim 1, in which an environmental coating, of synthetic resin, is provided between said terminal plates above said resistance film.

10. The invention as claimed in claim 1, in which a glass coating is provided over said resistance film, and in which an environmental coating, of synthetic resin, is provided between said terminal plates over said glass coating.

11. The invention as claimed in claim 1, in which said resistance film is a single layer resistance film.

12. The invention as claimed in claim 11, in which said chip resistor includes only one said single layer resistance film.

13. The invention as claimed in claim 11, in which said single layer resistance film is a thick-film resistance material.

14. The invention as claimed in claim 1, in which the upper surfaces of each said terminal plates being flat from said one side region thereof to said opposite side region thereof and from one end region thereof to the opposite end region thereof, and in which the entire said top surfaces of each terminal plates being left exposed for subsequent attachment of wire leads.

15. The invention as claimed in claim 1, in which each said terminal plates being directly connected to each said metalizations by solder, and each said metalizations being directly connected to said resistance film.

16. The invention as claimed in claim 1, in which the end portions of said resistance film being directly connected to said upper surfaces of said metalizations.

17. The invention as claimed in claim 1, in which said terminal plates being preformed bulk metal plates.

18. The invention as claimed in claim 1, in which an entire bottom surface of said resistance film directly contacts said upper surface of said substrate, and an entire top surface of said resistance film directly contacts a glass layer.

19. A low resistance, high-power chip resistor having a small resistive-film area relative to resistor size, which comprises:

(a) a generally rectangular resistor substrate formed of ceramic, (b) first and second preformed discrete terminal plates formed of highly-electrically-conductive high-thermal-conductivity metal, said terminal plates being large in comparison to the size of said resistor substrate, each of said terminal plates extending from near one side edge of said resistor substrate to near the opposite side edge thereof, said terminal plates being parallel to each other and being bonded to said resistor substrate in spaced-apart relationship from each other, thereby forming opposed walls of said terminal plates, the space between said opposed walls of said terminal plates being narrow in comparison to the dimensions of said terminal plates in a direction from said one side edge of said substrate to said opposite side edge thereof, thereby forming said spaced between said opposed walls of said terminal plates that has a width narrow in comparison to its length, and (c) a resistance film screen-printed on said resistor substrate forming a single layer of resistance film on the same side thereof as said terminal plates, said screen-printed resistance film filling said space between said opposed walls of said terminal plates, said resistance film being electrically connected to said terminal plates so that current flows through said film across said space.

20. The invention as claimed in claim 19, in which the electrical resistance of said resistance film is less than about one ohm.

21. The invention as claimed in claim 19, in which said resistor is mounted on and parallel to a heat-sinking circuit substrate in heat-sinking relationship thereto.

22. The invention as claimed in claim 21, in which said heat-sinking relationship to said circuit substrate comprises means to bond the lower surface of said ceramic resistor substrate to the upper surface of said heat-sinking circuit substrate.

23. The invention as claimed in claim 21, in which said resistor is inverted, and said heat-sinking relationship to said circuit substrate comprises means to bond the lower surfaces of said terminal plates to the upper surface of said heat-sinking circuit substrate.

24. The invention as claimed in claim 22, in which current leads can be randomly positioned on exposed surfaces of said terminal plates opposite said resistor substrate and are connected between said heat-sinking circuit substrate and said respective terminal plates, and in which sense leads can be randomly positioned on said exposed surfaces of said terminal plates opposite said resistor substrate and are connected between said heat-sinking circuit substrate and said respective terminal plates.

25. The invention as claimed in claim 24, in which the resistance tolerances of said resistor are in the range about 0.1% to about 1% despite random variations in the locations at which said leads are connected to said terminal plates.

26. The invention as claimed in claim 19, in which a glass coating is provided over said resistance film.

27. The invention as claimed in claim 19, in which an environmental coating, of synthetic resin, is provided between said terminal plates above said resistance film.

28. The invention as claimed in claim 19, in which a glass coating is provided over said resistance film, and in which an environmental coating is provided between said terminal plates over said glass coating.

29. The invention as claimed in claim 19, in which said chip resistor is mounted on a heat-sinking circuit substrate with the bottom of said resistor substrate bonded by solder, in high heat-transfer relationship, to the upper surface of said heat-sinking circuit substrate.

30. The invention as claimed in claim 29, in which a metalization layer is interposed between the bottom surface of said resistor substrate and said solder that bonds to said heat-sinking circuit substrate.

31. The invention as claimed in claim 19, in which said resistor has an electric resistance in the range of one ohm and lower, and has a resistance tolerance in the range plus or minus 1% down to plus or minus 0.1%.

32. The invention as claimed in claim 19, in which said screen-printed resistance film occupies less than fifty percent of the top surface area of said resistor substrate.

33. The invention as claimed in claim 19, in which a metalization is provided between the bottom surface of each of said terminal plates and said ceramic resistor substrate.

34. The invention as claimed claim 21, in which said resistor is inverted, and solder layers are provided in bonded relationships to the sides of said terminal plates remote from said resistor substrate, and to said heat-sinking circuit substrate.

35. The invention as claimed in claim 19, in which said screen-printed resistance film covers most of said space between said opposed walls of said terminal plates.

* * * * *